United States Patent [19]

Rauch

[11] 4,381,832

[45] May 3, 1983

[54] EXHAUST SILENCER HAVING AN INCORPORATED RESONATOR FOR AN INTERNAL COMBUSTION ENGINE

[75] Inventor: Jean Rauch, Bart, France

[73] Assignees: Automobiles Peugeot; Automobiles Citroen, both of Paris, France

[21] Appl. No.: 299,935

[22] Filed: Sep. 8, 1981

[30] Foreign Application Priority Data

Sep. 8, 1980 [FR] France ..... 80 19339

[51] Int. Cl.[3] ..... F01N 1/02

[52] U.S. Cl. ..... 181/266; 181/272

[58] Field of Search ..... 181/240, 250, 265, 266, 181/268, 272, 273, 275

[56] References Cited

U.S. PATENT DOCUMENTS 3,447,629 6/1969 Placek ..... 181/266

3,993,160 11/1976 Rauch ..... 181/266

FOREIGN PATENT DOCUMENTS 1263608 5/1961 France .

*Primary Examiner*—Benjamin R. Fuller

*Attorney, Agent, or Firm*—Burns, Doane, Swecker & Mathis

[57] ABSTRACT

The exhaust silencer of the invention improves the various attenuation characteristics without increasing the overall size of the silencer. This is achieved by disposing the pressure take-off of the low-frequency resonator in an end wall of the case of the silencer and by placing the neck of this resonator partly outside the case. The associated chamber is located inside the reflection and interference attenuation stage.

4 Claims, 5 Drawing Figures

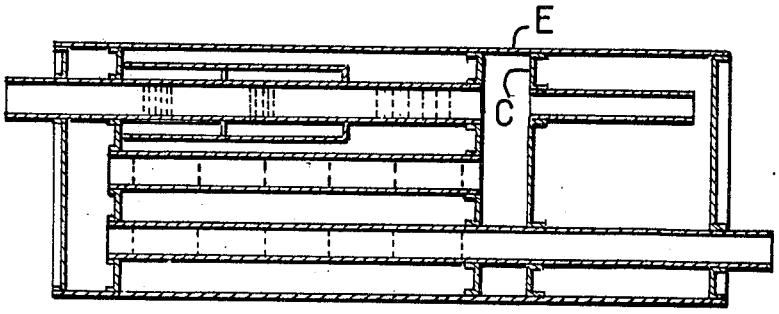
FIG.1 (PRIOR ART)
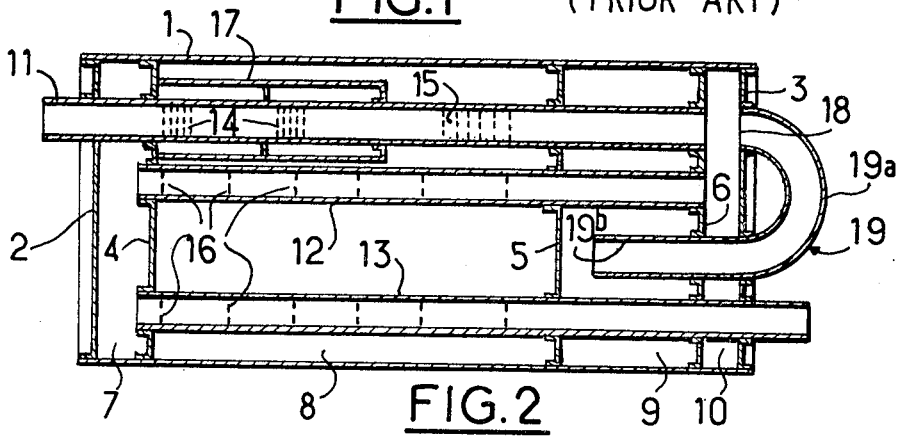
FIG.2
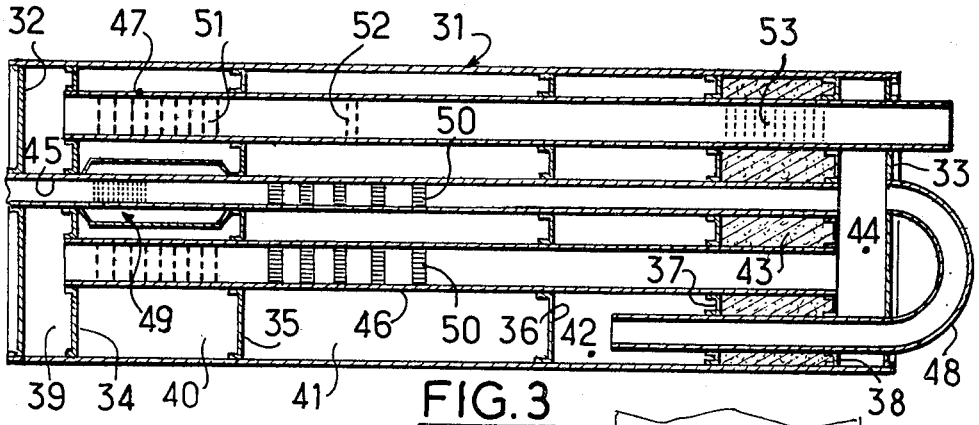
FIG.3
FIG.5
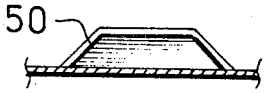
FIG.4
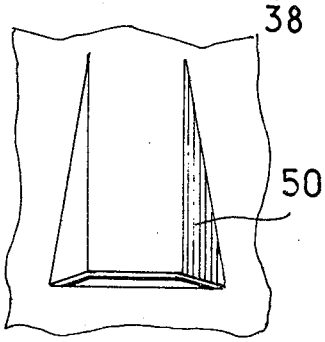

EXHAUST SILENCER HAVING AN INCORPORATED RESONATOR FOR AN INTERNAL COMBUSTION ENGINE

The invention relates to the field of exhaust silencers for internal combustion engines.

It is known that the exhause noise spectra of these engines are characterised in particular by the predominance of the bass or low-frequency components with respect to the other frequencies (medium and high frequencies). The sound reduction requirements are increasingly strict and the adoption of resonators incorporated in the silencers have become generalised in difficult cases, bearing in mind that only the principle of the low-frequency resonator (Helmholtz resonator having a neck or a quarter-wave resonator) is capable of tackling the problem of the attenuation of the low frequencies, whether this concerns preventing these low-frequency components from contributing to the level of the interior noise of the vehicle or reducing the sound level of the mouth noise (exterior noise).

Consequently, it has become current practice to associate in the same silencer a plurality of acoustic attenuating principles: reflection, interference, absorption, in order to cover as far as possible the range of the frequencies of the spectrum in accordance with the relative importance of the various components. Any modern silencer intended to attenuate the components corresponding to a frequency band ranging from the high frequencies to the low frequencies and including the medium frequencies consequently includes a plurality of attenuation stages.

Thus the accompanying FIG. 1 represents a known silencer comprising a case E which is separated by a transverse partition wall C into two parts: a first part located on the left in the drawing in which there are disposed the means performing the functions of reflection and interference, and a second, located on the right, which constitutes the Helmholtz resonator. This known arrangement has the drawback of shortening, for a given overall length of the silencer, the length of the reflection and interference stage to the extent of the length of the resonator stage. Now, the attenuation of the medium-frequency components whose energy is midway between those of the low and high frequencies, achieved in the reflection and interference stage, is increased in effectiveness with the length of this stage. Indeed, the stage in question comprises at least two perforated pipes which pass through a chamber and whose disposition permits superimposing two attenuation principles, namely reflection and interference.

The reflection is achieved by the perforations with which the pipes are provided, each of the openings being associated with the corresponding fraction of the chamber and constituting with the latter an elementary Helmholtz resonator. For reasons of overall pressure drop on one hand, and acoustic efficiency on the other, there is usually chosen a sum of openings per pipe which is of the order of the flow section of the latter. Thus, for a given perforation, the cut-off frequency is all the more lower as the chamber travelled through is greater, whence the interest of a maximum length for a given section of silencer.

The interference is achieved by the operating differences realised. The frequency band concerned by this type of attenuation is the wider as the range of the operating differences achieved is large. Bearing in mind the orders of magnitude employed (spectrum and dimension of the silencer), the attenuation of the medium-frequency (MF) components is improved with increase in the characteristic length. An object of the present invention is consequently to provide a silencer of the type comprising a reflection and interference stage and at least one Helmholtz resonator which, for a given overall size, provides improved attenuation characteristics.

The invention provides an exhaust silencer for an internal combustion engine, comprising a case including a lateral wall and two end walls defining at least one first reflection and/or interference attenuation stage and at least a second stage constituting a Helmholtz resonator formed by a chamber and a neck constituting a pressure take-off which communicates with the first stage, wherein the pressure take-off of the second stage is effected from an end wall of the case by means of a neck which is at least partly located outside the case, and the chamber of the resonator is disposed inside the first stage.

The invention will be described in more detail hereinafter with reference to the accompanying drawing in which:

FIG. 1 represents, as already indicated, a developed sectional view of an exhaust silencer of the prior art;

FIG. 2 is a similar view of an improved silencer according to the invention;

FIG. 3 is also a developed sectional view of a modification and,

FIGS. 4 and 5 are detail views to an enlarged scale of a part of the silencer of FIG. 3.

The prior art silencer shown in FIG. 1 will not be described in detail but will serve as a reference when mentioning the advantages of the invention.

The invention, a first embodiment of which is shown in FIG. 2, concerns a silencer comprising a case 1 which is closed at both ends by two walls 2 and 3. This case is moreover separated by three partition walls 4, 5 and 6 into four chambers carrying reference numerals 7, 8, 9 and 10 respectively. It is completed by three tubes or pipes, namely an inlet pipe 11, an intermediate pipe 12 and an outlet pipe 13, which are provided in the conventional manner with orifices or openings such as those designated for example by the references 14, 15 and 16. The orifices 14 constitute with an outer pipe section 17 a high-frequency resonator, the assembly of the three pipes 11, 12, 13 with their orifices and the volumes surrounding them constituting, moreover, a reflection and interference attenuation stage.

According to the invention, the chamber 9, through which the pipes 11, 12 and 13 extend, constitutes a low-frequency resonator or Helmholtz resonator whose pressure take-off is located in the end wall 3 in axial alignment with the inlet pipe 11. The neck 19 of the low-frequency resonator extends from this pressure take-off and includes a curved portion **19*a* located outside the case, and a rectilinear portion 19*b* which, once again, extends inside this case and opens into the chamber 9 at a relatively short distance from the partition wall 5. If this arrangement is compared with that of FIG. 1 which represents a silencer of identical dimensions (the apparent difference of diameter between FIGS. 1 and 2** is merely the result of the development of the section), the following advantages of the invention may be revealed:

as concerns the attenuation by interference, the arrangement according to the invention permits the use of the entire length of the silencer which is, in the prior art, shortened to the extent of the length of the volume of the low-frequency resonator. This results from the arrangement of the pressure take-off and of the neck of this resonator and the fact that the chamber 9 which is employed as a low-frequency resonator chamber, is located in the reflection and interference stage and has extending therethrough the pipes which are part of this stage;

as concerns the attenuation by reflection, the arrangement according to the invention permits taking advantage of, for a given cut-off frequency of the low-frequency resonator, of an increased volume relative to the known arrangement;

as concerns the low-frequency resonator itself, the arrangement according to the invention permits markedly increasing the length of the neck without however shortening the characteristic length of the reflection and interference stage and lowering the cut-off frequency for a given volume of the chamber; moreover, at a given cut-off frequency and section of the chamber, the required volume of the chamber may be reduced.

The advantages are considerable if it is considered that they are obtained without modification of the overall size of the silencer and without increasing its cost.

The modification shown in FIG. 3 illustrates the fact that the application of the invention is possible in silencers of various constructions. In this modification, the silencer comprises a case 31, two end walls 32, 33 and intermediate partition walls 34, 35, 36, 37, 38 which define chambers 39, 40, 41, 42, 43, 44. Three pipes are also provided, namely an inlet pipe 45, an intermediate pipe 46 and an outlet pipe 47. The low-frequency resonator is here formed by the chamber 42 and by a neck 48 which extends from the end wall 33 and constitutes a pressure take-off disposed in alignment with the inlet pipe 45. Further, the various means provided in the reflection and interference stage are the following, with respect to the order of passage of the gases:

a silencer 49 constituting a very high-frequency resonator which contributes to the suppression of the cut-off noise;

a high-frequency and medium-frequency reflection and interference stage formed by "venetian blind" orifices 50 provided on the pipes 45 and 46; an example of these venetian blinds is shown in more detail in FIGS. 4 and 5;

a second reflection and interference stage 51;

a special so-called reference perforation 52;

a high-frequency reflection or absorption outlet stage 53.

Of course, the same advantages are obtained as in the preceding embodiment and it is quite clear that the invention is applicable to silencers of structure and construction which are different from those which have been illustrated.

Having now described my invention what I claim as new and desire to secure by Letters Patent is:

1. In an exhaust silencer for the exhaust gases of an internal combustion engine, comprising a case, an inlet pipe and an outlet pipe connected to the case, the case being formed by a lateral wall and two end walls defining at least a first reflection attenuation stage and at least a second stage constituting a Helmholtz resonator, formed by a chamber and a neck constituting a pressure take-off communicating with said first stage; the improvement wherein the chamber of the resonator is disposed inside said first stage and the pressure take-off of said second stage is formed adjacent one of said end walls of the case by means of a neck which extends through said one end wall and partly outside the case and re-enters the case and extends partly inside said first stage and is devoid of any connection to said inlet pipe and outlet pipe outside said case.

2. An exhaust silencer according to claim 1, wherein said first stage is also operative by interference.

3. In an exhaust silencer for the exhaust gases of an internal combustion engine, comprising a case, an inlet pipe and an outlet pipe connected to the case, the case being formed by a lateral wall and two end walls defining at least a first interference attenuation stage and at least a second stage constituting a Helmholtz resonator, formed by a chamber and a neck constituting a pressure take-off communicating with said first stage; the improvement wherein the chamber of the resonator is disposed inside said first stage and the pressure take-off of said second stage is formed adjacent to one of said end walls of the case by means of a neck which extends through said one end wall and partly outside the case and re-enters the case and extends partly inside said first stage and is devoid of any connection to said inlet pipe and outlet pipe outside said case.

4. A silencer according to claim 1, 2 or 3, wherein the pressure take-off of the resonator is located in an end wall of the case which is opposed to said inlet pipe and is in alignment with said inlet pipe.

* * * * *